US010349731B2

(12) United States Patent
Sueyoshi et al.

(10) Patent No.: US 10,349,731 B2
(45) Date of Patent: Jul. 16, 2019

(54) BEAUTY APPARATUS

(71) Applicant: Panasonic Intellectual Property Management Co., Ltd., Osaka (JP)

(72) Inventors: Hidekazu Sueyoshi, Shiga (JP); Kazuyasu Ikadai, Shiga (JP); Natsumi Hashimoto, Shiga (JP); Seiko Yabuuchi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 380 days.

(21) Appl. No.: 15/352,588

(22) Filed: Nov. 16, 2016

(65) Prior Publication Data

US 2017/0150851 A1 Jun. 1, 2017

(30) Foreign Application Priority Data

Nov. 30, 2015 (JP) ..... 2015-232645

(51) Int. Cl.
*A46B 7/08* (2006.01)
*A46B 9/02* (2006.01)
(Continued)

(52) U.S. Cl.
CPC ..... *A46B 13/008* (2013.01); *A46B 7/08* (2013.01); *A46B 9/02* (2013.01); *A46B 9/06* (2013.01);
(Continued)

(58) Field of Classification Search
CPC .... A46B 7/08; A46B 9/02; A46B 9/06; A46B 13/00; A46B 13/008; A46B 13/02;
(Continued)

(56) References Cited

U.S. PATENT DOCUMENTS 6,058,541 A * 5/2000 Masterman ..... A46B 9/04 15/167.1
2014/0058300 A1 2/2014 Ungemach et al.
(Continued)

FOREIGN PATENT DOCUMENTS

DE 102007007614 * 8/2008
DE 102007007616 A1 8/2008
(Continued)

OTHER PUBLICATIONS

The Extended European Search Report dated Apr. 24, 2017 for the related European Patent Application No. 16199318.3.

*Primary Examiner* — Mark Spisich
(74) *Attorney, Agent, or Firm* — McDermott Will & Emery LLP

(57) ABSTRACT

A beauty apparatus according to the present disclosure includes a main body including a grip, and a brush part rotatably mounted to the main body. The brush part includes a first brush having a tuft of a plurality of bristles, and a second brush thicker than each of the plurality of bristles. A plurality of the second brushes disposed around a rotation center of the brush part is made greater in number than a plurality of the second brushes disposed along an outer circumference of the brush part. The beauty apparatus is capable of more uniform removal of dirt from skin.

8 Claims, 9 Drawing Sheets

(51) Int. Cl.

| | |
|---|---|
| ***A46B 9/06*** | (2006.01) |
| ***A47K 7/04*** | (2006.01) |
| ***A61H 7/00*** | (2006.01) |
| ***A46B 13/02*** | (2006.01) |
| ***A46B 13/04*** | (2006.01) |
| ***A46B 13/00*** | (2006.01) |

(52) U.S. Cl.
CPC ..... *A46B 13/02* (2013.01); *A46B 13/04* (2013.01); *A47K 7/043* (2013.01); *A61H 7/005* (2013.01); *A46B 2200/102* (2013.01); *Y10S 15/05* (2013.01); *Y10S 15/06* (2013.01)

(58) Field of Classification Search
CPC ..... A46B 13/04; A46B 2200/10; A46B 2200/1006; A46B 2200/102; A46B 2200/1033; A47K 7/043; Y10S 15/05; Y10S 15/06; A61H 7/00; A61H 7/002; A61H 7/003; A61H 7/004; A61H 7/005; A61H 23/02; A61H 23/0254; A61H 2201/105; A61H 2201/02; A61H 2201/0207; A61H 2201/0221; A61H 2201/0228; A61H 2201/0235
USPC ..... 15/28, 29, 180, DIG. 5, DIG. 6; 601/15, 601/17, 112, 114
See application file for complete search history.

(56) References Cited

U.S. PATENT DOCUMENTS

| | | | | |
|---|---|---|---|---|
| 2014/0309662 | A1* | 10/2014 | Brewer | A45D 34/042 606/131 |
| 2015/0141884 | A1* | 5/2015 | Thiebaut | A61H 7/00 601/112 |
| 2015/0173998 | A1* | 6/2015 | Thiebaut | A61H 7/005 601/114 |

FOREIGN PATENT DOCUMENTS

| | | | |
|---|---|---|---|
| EP | 2253242 | | * 11/2010 |
| JP | 2015-524728 | | 8/2015 |
| WO | 2001/056529 | A2 | 8/2001 |

* cited by examiner

BEAUTY APPARATUS

BACKGROUND

1. Technical Field

The present disclosure relates to a beauty apparatus.

2. Description of the Related Art

A conventional beauty apparatus is proposed by, for example, Japanese Translation of PCT Publication No. 2015-524728. The proposed beauty apparatus includes a main body and a brush part rotatably mounted to one end of the main body, and the brush part is formed with brushes of a plurality of types.

In the above conventional technique, however, the brushes of each of the types are disposed to be greater in number along an outer circumference of the brush part than around a rotation center of the brush part. In other words, the brushes of the same type are disposed so as to be greater in number along the outer circumference where peripheral velocity is relatively high than they are around the rotation center where the peripheral velocity is relatively low.

For this reason, in cases where, for example, brushes having relatively high cleaning power are arranged as described above and a brush part is rotated with the brushes abutted on a skin surface for skin cleaning, skin cleaning power may differ between a rotation center side and an outer circumference side of the brush part.

SUMMARY

To solve the above conventional problem, the present disclosure aims to provide a beauty apparatus capable of more uniform removal of dirt from skin.

To achieve the above object, a beauty apparatus according to the present disclosure includes a main body including a grip, and a brush part rotatably mounted to the main body.

The brush part includes a first brush having a tuft of a plurality of bristles, and a second brush thicker than each of the plurality of bristles.

A plurality of the second brushes disposed around a rotation center of the brush part is made greater in number than a plurality of the second brushes disposed along an outer circumference of the brush part.

Accordingly, difference in skin cleaning power is reduced between a rotation center side and an outer circumference side of the brush part when the brush part is rotated with the brushes abutted on a skin surface for skin cleaning, thereby enabling more uniform removal of dirt from skin.

According to the present disclosure, the beauty apparatus obtained is capable of the more uniform removal of the dirt from the skin.

DETAILED DESCRIPTION

Figure 1:
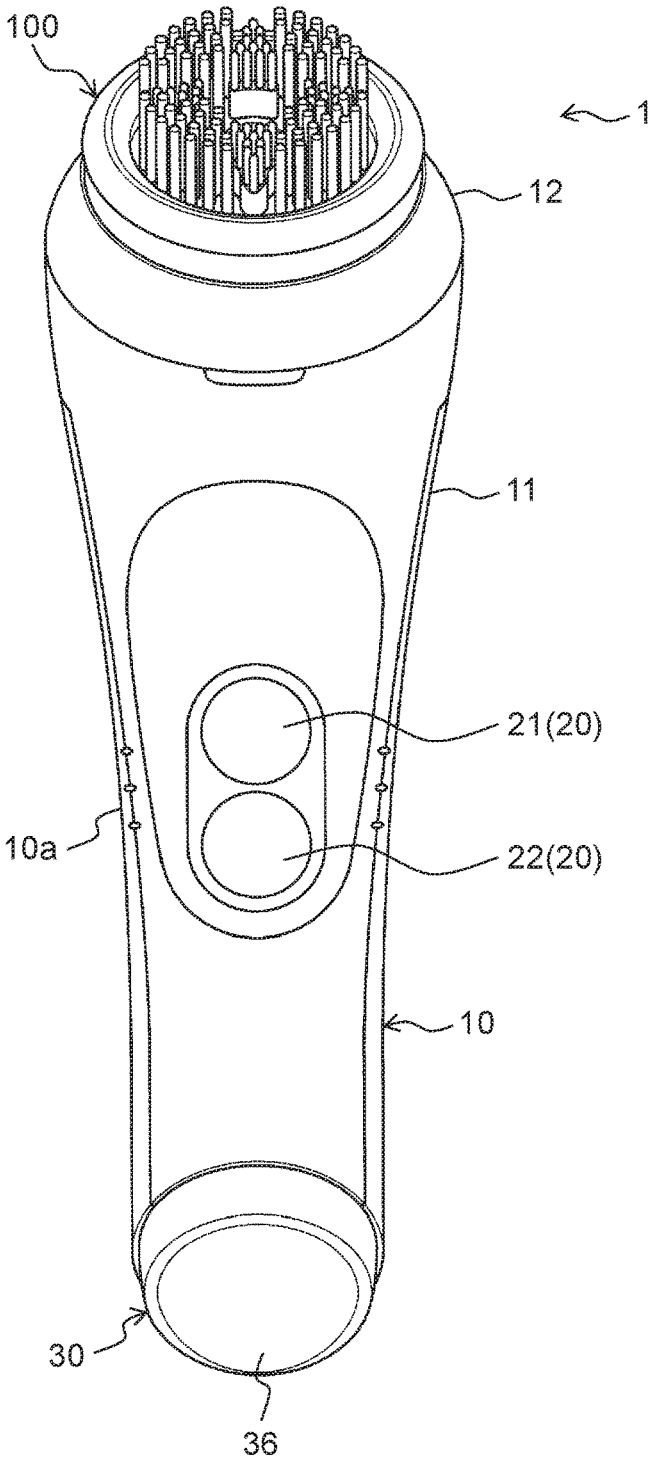
FIG. 1 is a front view of a beauty apparatus according to an exemplary embodiment of the present disclosure.

A beauty apparatus according to an exemplary embodiment of the present disclosure includes a main body including a grip, and a brush part rotatably mounted to the main body.

The brush part includes a first brush having a tuft of a plurality of bristles, and a second brush thicker than each of the plurality of bristles.

A plurality of the second brushes disposed around a rotation center of the brush part is made greater in number than a plurality of the second brushes disposed along an outer circumference of the brush part.

Accordingly, difference in skin cleaning power is reduced between a rotation center side and an outer circumference side of the brush part when the brush part is rotated with the brushes abutted on a skin surface for skin cleaning, thereby enabling more uniform removal of dirt from skin.

With the thick second brush abutted on the skin surface while being rotated, dead skin cells that are hard to remove with normal brushes can be removed, while the dirt can be removed from the skin surface by the brush having the thinner bristles. Here, the dead skin cells can be removed more efficiently even near the rotation center where peripheral velocity is low, so that the dirt can be removed more uniformly from the skin.

The pluralities of the second brushes are disposed on respective concentric circles having a center of the concentric circles at the rotation center of the brush part.

When a comparison is made of numbers of the pluralities of the second brushes disposed on radially adjacent concentric circles among the concentric circles, the number of the plurality of the second brushes disposed on the concentric circle closer to the rotation center of the brush part is not less than the number of the plurality of the second brushes disposed on the outer concentric circle.

Accordingly, the difference in skin cleaning power can be reduced further between the rotation center side and the outer circumference side of the brush part, thereby enabling more uniform removal of the dirt from the skin.

Each of the second brushes is higher in hardness than the first brush.

This enables more reliable removal of the dead skin cells that are hard to remove with the normal brushes.

Each of the second brushes is made of silicon.

The second brush made of silicon can thus remove the dead skin cells adhering to the skin surface by rubbing the skin with reduced skin irritation.

A leading end of the first brush projects further than a leading end of each of the second brushes.

In this way, the second brush is prevented from abutting strongly on the skin, thereby reducing skin irritation.

When viewed along a rotation center axis, the brush part is divided into a region where the first brush is disposed and a region where the second brush is disposed.

With the second brush disposed in the predetermined region, skin cleaning power can be increased as compared with cases where the second brushes are disposed dispersively.

A plurality of the regions where a plurality of the second brushes is disposed is formed circumferentially.

Accordingly, when the brush part is rotated with the brushes abutted on the skin surface for skin cleaning, the first brushes and the second brushes alternate in cleaning the skin, whereby the skin cleaning power can be increased further with reduced skin irritation.

An area of the region where the second brush is disposed is not more than a half of an area of the region where the first brush is disposed.

With the area of the region where the second brush is disposed being not more than the half of the area of the region where the first brush is disposed, more reliable reduction of the skin irritation can be achieved.

The brush part is formed with a hole enabling passage of a cleanser.

The cleanser such as present inside the main body can thus be fed to the first brush and the second brush during skin cleaning, thereby increasing the skin cleaning power further.

Exemplary Embodiment

Beauty apparatus 1 according to the exemplary embodiment is a handheld beauty apparatus used mainly for facial cleaning. As shown in FIG. 1, beauty apparatus 1 includes main body 10 formed with grip 10*a*, and head 100 detachably mounted to main body 10.

Head 100 expedites removal of dirt from a target part to be cleaned (such as facial skin) through rubbing of the target part with first brushes 111 and second brushes 112 that are fed with foam (cleanser).

Figure 3:
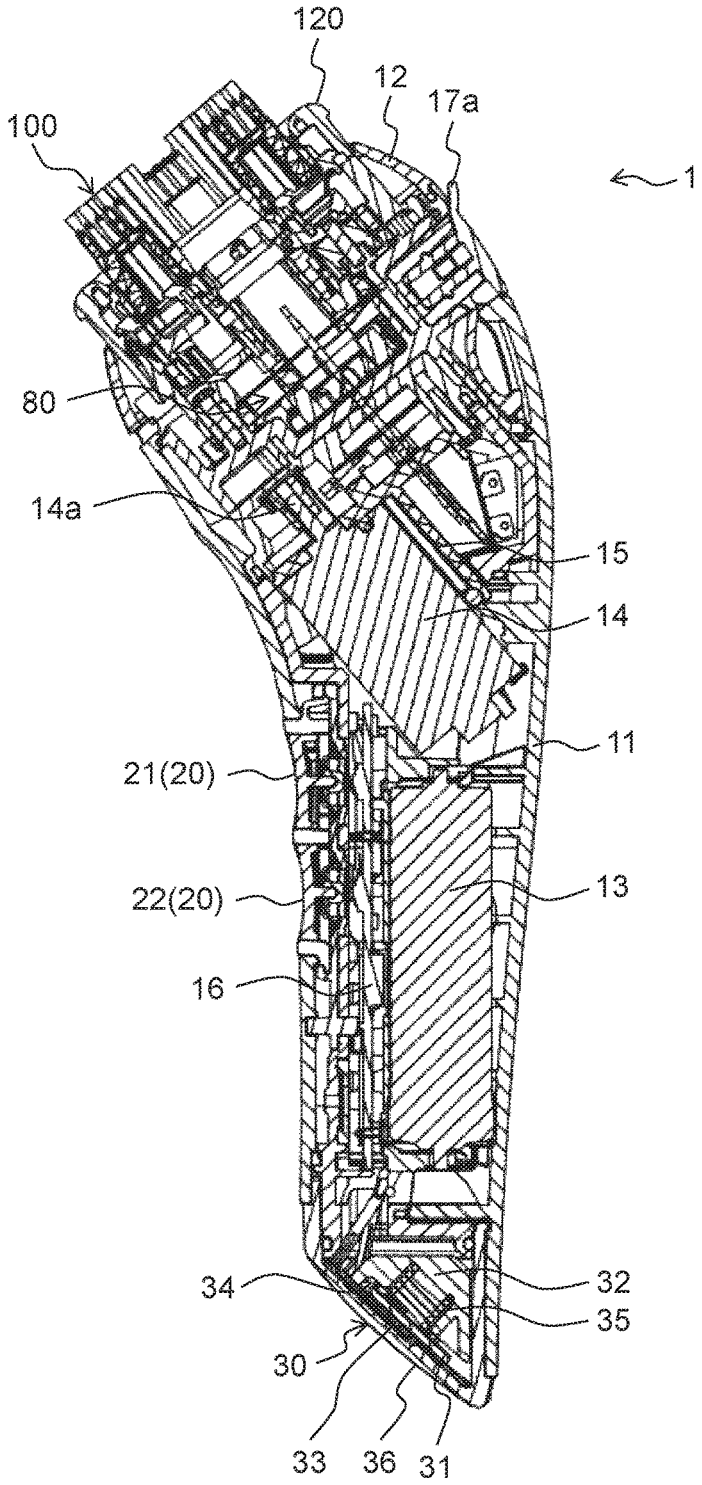
FIG. 3 is a sectional view of the beauty apparatus according to the exemplary embodiment of the present disclosure.

Main body 10 includes housing 11 that accommodates various components including drive source 14 (refer to FIG. 3), cap 12 mounted to a top portion of housing 11, operation part 20 that is operated for driving beauty apparatus 1, and warming mechanism 30 for outputting heat. In the present exemplary embodiment, warming mechanism 30 is disposed at a bottom of housing 11. It is to be noted that warming mechanism 30 can be omitted.

Figure 2:
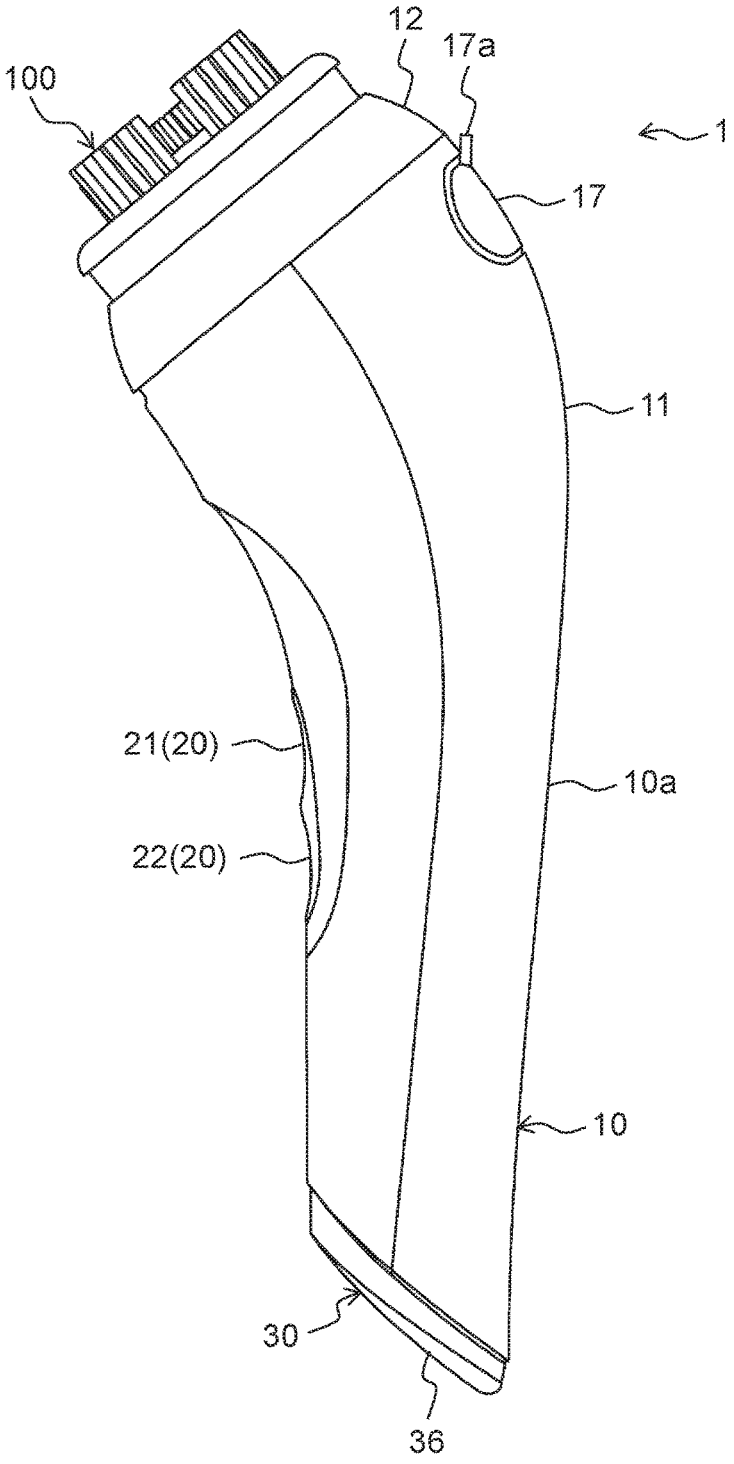
FIG. 2 is a side view of the beauty apparatus according to the exemplary embodiment of the present disclosure.

Housing 11 has a waterproof structure, and grip 10*a* is provided at a middle of housing 11. In the present exemplary embodiment, as shown in FIG. 2, housing 11 is such that a top portion (mounted with head 100) of housing 11 is bent with respect to a grip portion (grip 10*a*) of housing 11. By being bent with respect to the grip portion of housing 11, the top portion of housing 11 facilitates abutment of head 100 on skin when a user holds the grip portion of housing 11.

Housing 11 is formed with, in its back surface, inlet 18 (refer to FIG. 5) from which a foaming agent (the cleanser) is poured into housing 11. Examples of the foaming agent used for beauty apparatus 1 include a foaming agent in gel form and a foaming agent in liquid form.

Main body 10 further includes lid 17 for closing inlet 18, and lid 17 is rotatably mounted to housing 11. As lug 17*a* formed on lid 17 is pulled to cause rotation of lid 17, inlet 18 is opened. It is to be noted that lid 17 may be detachably provided to housing 11 so that inlet 18 is opened by detachment of lid 17 from housing 11.

Operation part 20 can be formed of, for example, buttons. In the present exemplary embodiment, operation part 20 includes first operation unit 21 for switching drive source 14 between on and off, and second operation unit 22 for switching warming mechanism 30 between on and off. In other words, when operated, first operation unit 21 outputs an ON signal that is an operation signal for changing drive source 14 from OFF to ON or an OFF signal that is an operation signal for changing drive source 14 from ON to OFF. On the other hands, second operation unit 22 outputs, when operated, an ON signal that is an operation signal for changing warming mechanism 30 from OFF to ON or an OFF signal that is an operation signal for changing warming mechanism 30 from ON to OFF.

Main body 10 further includes power supply 13 for supplying power of a primary battery or a secondary battery to electric blocks, drive source 14 that is driven by the power supplied from power supply 13, base mount 15 holding drive source 14, and drive mechanism 40 formed of a plurality of machine elements. These components (power supply 13, drive source 14, base mount 15, and drive mechanism 40) are accommodated by housing 11.

As an example of drive source 14, a motor can be used. In the present exemplary embodiment, output shaft 14*a* of drive source 14 is connected to a part of drive mechanism 40.

Main body 10 further includes controller 16 for controlling drive source 14 and warming mechanism 30. This controller 16 controls drive source 14 and warming mechanism 30 based on the operation signals output from first operation unit 21 and second operation unit 22, respectively. In the present exemplary embodiment, with either drive source 14 or warming mechanism 30 being driven, controller 16 inhibits driving of the other. With either drive source 14 or warming mechanism 30 being driven, such inhibition can be effected by, for example, setting a flag that inhibits the driving of the other.

Warming mechanism 30 includes warming surface 36 formed at the bottom of housing 11, heater 31 that is driven by the power supplied from power supply 13, base mount 32 holding heater 31, and heat transfer plate 33 for transmitting heat of heater 31 to warming surface 36. Warming mechanism 30 further includes thermistor 34 for controlling temperature of heater 31, and spring 35 that applies force to heater 31 for pressing heater 31 against heat transfer plate 33.

Figure 4:
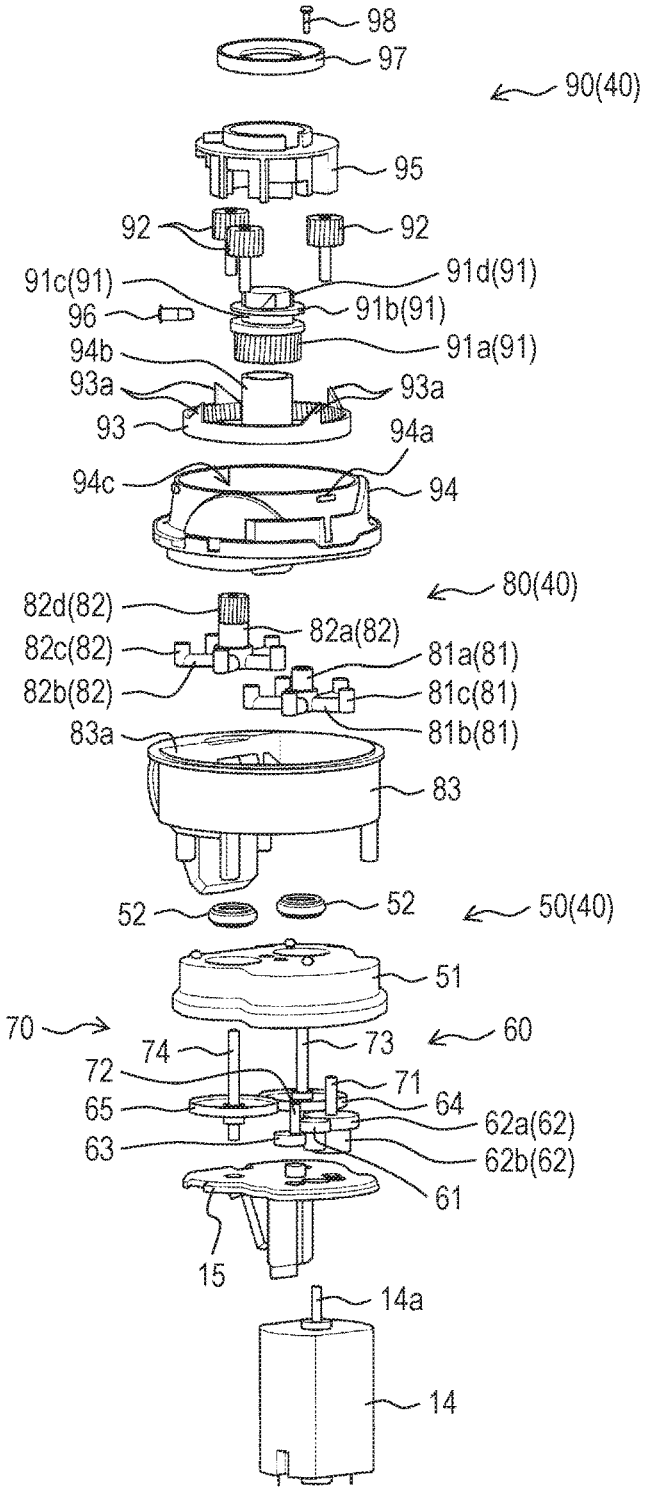
FIG. 4 is an exploded perspective view illustrating a drive source and a drive mechanism of the beauty apparatus according to the exemplary embodiment of the present disclosure.

As shown in FIG. 4, drive mechanism 40 includes foam generating mechanism 80 that generates foam (from the cleanser) and feeds the foam to head 100 (refer to FIG. 1), first transmission block 50 that transmits driving force of drive source 14 to foam generating mechanism 80, and second transmission block 90 that transmits the driving force of drive source 14 to head 100.

Figure 5:
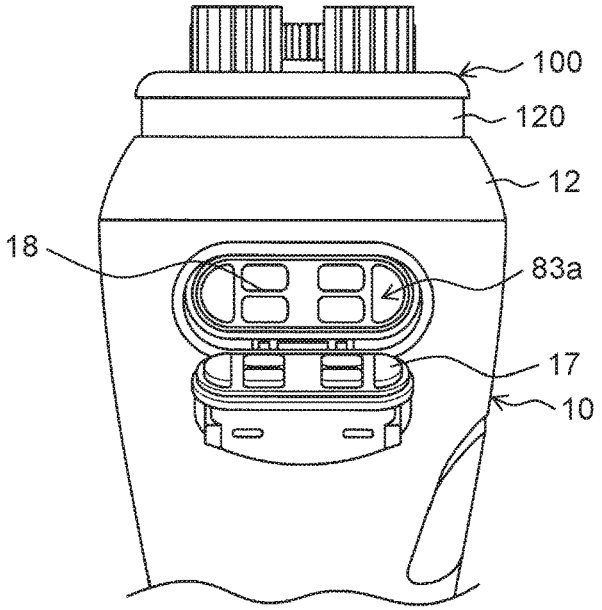
FIG. 5 is an enlarged rear view illustrating the beauty apparatus with its lid being open according to the exemplary embodiment of the present disclosure.

Foam generating mechanism 80 includes first rotor 81 and second rotor 82 that generate foam by stirring the foaming agent, water and air together, and container 83 having space 83*a* for storage of the foaming agent and the water. In the present exemplary embodiment, first rotor 81 and second rotor 82 are disposed within space 83*a* of container 83 and rotate in opposite directions. It is to be noted that as shown in FIG. 5, space 83*a* of container 83 communicates with inlet 18 of main body 10.

First transmission block 50 includes, as shown in FIG. 4, gear group 60 composed of a plurality of gears, support shaft group 70 composed of a plurality of shafts for supporting gear group 60, gear case 51 accommodating gear group 60, and two packings 52 that prevent, for example, the liquid from flowing into gear case 51. It is to be noted that gear case 51 is connected to base mount 15 in the present exemplary embodiment.

Gear group 60 specifically includes rotation driving gear 61, compound gear 62, rotation changing gear 63, first rotation transmitting gear 64, and second rotation transmitting gear 65. Compound gear 62 includes two gears of different diameters, that is to say, first compound gear 62*a* and second compound gear 62*b*.

Support shaft group 70 specifically includes first support shaft 71 connecting with compound gear 62, second support shaft 72 connecting with rotation changing gear 63, third support shaft 73 connecting with first rotation transmitting gear 64, and fourth support shaft 74 connecting with second rotation transmitting gear 65.

Packings 52 are mounted to respective holes in gear case 51 that are intended for respective passages of third support shaft 73 and fourth support shaft 74. By being mounted to the respective holes in gear case 51, packings 52 can prevent, for example, the liquid from flowing into gear case 51 from container 83.

In the present exemplary embodiment, output shaft 14*a* of drive source 14 supports rotation driving gear 61, so that output shaft 14*a* and rotation driving gear 61 rotate integrally. Rotation driving gear 61 meshes with first compound gear 62*a*, and first compound gear 62*a* meshes with first rotation transmitting gear 64. Accordingly, first rotation transmitting gear 64 and third support shaft 73 rotate integrally. Third support shaft 73 supports first rotor 81, so that third support shaft 73 and first rotor 81 rotate integrally.

As output shaft 14*a* rotates, rotation of output shaft 14*a* is thus transmitted through rotation driving gear 61, first compound gear 62*a*, first rotation transmitting gear 64, and first rotor 81 in this order. Here, the rotation of output shaft 14*a* that is transmitted to first rotor 81 is decelerated by gears 61, 62*a*, 64.

First compound gear 62*a* meshing with rotation driving gear 61 rotates integrally with second compound gear 62*b*. Second compound gear 62*b* meshes with rotation changing gear 63, and rotation changing gear 63 meshes with second rotation transmitting gear 65. Accordingly, second rotation transmitting gear 65 and fourth support shaft 74 rotate integrally. Fourth support shaft 74 supports second rotor 82, so that fourth support shaft 74 and second rotor 82 rotate integrally.

As output shaft 14*a* rotates, the rotation of output shaft 14*a* is thus transmitted through rotation driving gear 61, first compound gear 62*a*, second compound gear 62*b*, rotation changing gear 63, second rotation transmitting gear 65, and second rotor 82 in this order. Here, the rotation of output shaft 14*a* that is transmitted to second rotor 82 is decelerated by gears 61, 62*a*, 62*b*, 63, 65.

First rotor 81 includes base part 81*a* connected to third support shaft 73, a plurality of arms 81*b* extending from base part 81*a* in a substantially radial manner, and pillars 81*c* projecting upward from respective leading ends of arms 81*b*. In the present exemplary embodiment, respective roots of the plurality of arms 81*b* are equi-spaced around base part 81*a*. Arms 81*b* and pillars 81*c* contribute to expedited stirring of the foaming agent and the others.

Second rotor 82 includes base part 82*a* connected to fourth support shaft 74, a plurality of arms 82*b* extending from base part 82*a* in a substantially radial manner, pillars 82*c* projecting upward from respective leading ends of arms 82*b*, and rotation transmitting gear 82*d* connected to base part 82*a*. In the present exemplary embodiment, respective roots of the plurality of arms 82*b* are equi-spaced around base part 82*a*. Similarly to arms 81*b* and pillars 81*c*, arms 82*b* and pillars 82*c* contribute to the expedited stirring of the foaming agent and the others.

Gear group 60 forms two power transmission paths in the present exemplary embodiment, that is to say, a first power transmission path for transmitting the rotation of output shaft 14*a* to first rotor 81 and a second power transmission path for transmitting the rotation of output shaft 14*a* to second rotor 82.

In the present exemplary embodiment, rotation transmitting gear 82*d* meshes with a part of second transmission block 90.

Second transmission block 90 includes cam gear 91 and ring gear 93. Cam gear 91 and ring gear 93 are a first transmission mechanism and a second transmission mechanism, respectively and are each capable of transmitting torque to brush part 110 (described later) of head 100.

This second transmission block 90 further includes a plurality of planetary gears 92 meshing with ring gear 93, head mount 94 to which head case 120 of head 100 is detachably mounted, and bearing 94*b* supporting cam gear 91.

Head mount 94 includes a plurality of projections 94*a* for engagement in respective recesses (not shown) formed in head case 120 (described later) of head 100, and accommodating space 94*c* accommodating, for example, gears 91, 92, 93. Disposed within accommodating space 94*c*, bearing 94*b* is fixed to head mount 94. Cam gear 91 is rotatably supported to bearing 94. It is to be noted that cam gear 91 and bearing 94*b* are hollow elements, so that spaces within these respective elements communicate with space 83*a* of container 83.

Figure 7:
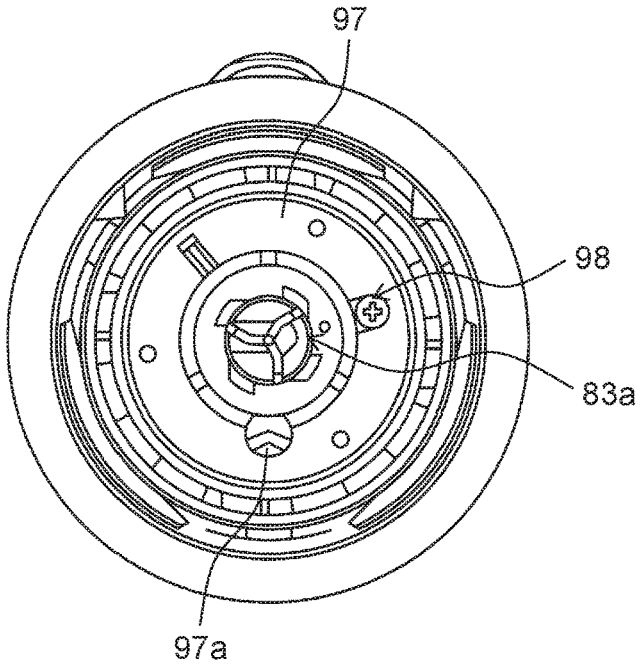
FIG. 7 is a plan view illustrating the drive mechanism of the beauty apparatus according to the exemplary embodiment of the present disclosure.

Second transmission block 90 further includes gear cover 95 covering gears 91, 92, 93, pin 96 inserted into a hole (not shown) in gear cover 95, and ring 97 disposed on a top surface of gear cover 95. Gear cover 95 and ring 97 are fixed to head mount 94 by screw 98. Ring 97 has a function of preventing, for example, the liquid from flowing into gear cover 95 and a function of preventing pin 96 from coming out in a radial direction of cam gear 91. In addition, as shown in FIG. 7, ring 97 is formed with hole 97*a* communicating with space 83*a* through gear cover 95.

Cam gear 91 includes gear part 91*a* meshing with rotation transmitting gear 82*d*, cam part 91*b* that converts rotation of gear part 91*a* into vertical motion relative to head mount 94, and a plurality of hooks 91*d* capable of transmitting the rotation of gear part 91*a* to brush part 110 of head 100. Cam part 91*b* is formed with spiral groove 91*c* on its outer circumference.

Figure 6:
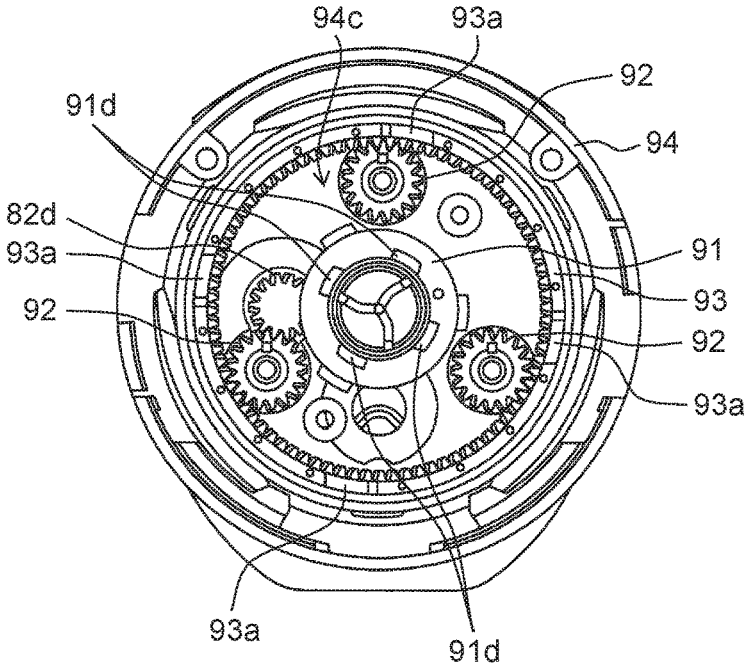
FIG. 6 is a plan view illustrating a part of the drive mechanism of the beauty apparatus according to the exemplary embodiment of the present disclosure.

As shown in FIG. 6, rotation transmitting gear 82*d* meshes with gear part 91*a* of cam gear 91 and one of planetary gears 92. In the present exemplary embodiment, planetary gears 92 are equi-spaced around cam gear 91 and mesh with ring gear 93.

Ring gear 93 is disposed within accommodating space 94*c* of head mount 94 and is rotatably supported by head mount 94. As shown in FIG. 4, ring gear 93 is formed with a plurality of hooks 93*a* that is capable of transmitting rotation of ring gear 93 to brush part 110 of head 100. It is to be noted that in the present exemplary embodiment, rotational speed of ring gear 93 is set lower than rotational speed of cam gear 91. For this reason, speed at which head 100 is operated (rotated) by ring gear 93 is lower than speed at which head 100 is operated (rotated) by cam gear 91.

Gear cover 95 is mounted to head mount 94, thereby closing an opening of head mount 94. With gear cover 95 being mounted to head mount 94, cam gear 91, planetary gears 92, and ring gear 93 are covered by gear cover 95.

Pin 96 is inserted into the hole formed in gear cover 95 from an outer periphery of gear cover 95 to have its leading end inserted in groove 91*c* of cam gear 91. By being inserted in groove 91*c* of cam gear 91 in this way, the leading end of pin 96 slides within groove 91*c* during the rotation of cam gear 91. With the leading end of pin 96 sliding within groove 91*c*, force that causes axial movement of cam gear 91 is applied to cam gear 91, whereby cam gear 91 moves (reciprocates) axially (vertically in FIG. 4) relative to head mount 94. In the present exemplary embodiment, cam gear 91 moves in a first axial direction that is an axial direction toward head 100 and in a second axial direction opposite to the first axial direction.

When the torque is transmitted to brush part 110 by cam gear 91, which is the first transmission mechanism, with head 100 mounted to main body 10, brush part 110 moves along an axis of rotation (vertically in FIG. 4) while rotating about rotation center C.

When the torque is transmitted to brush part 110 by ring gear 93, which is the second transmission mechanism, with head 100 mounted to main body 10, brush part 110 rotates about rotation center C.

Figure 8:
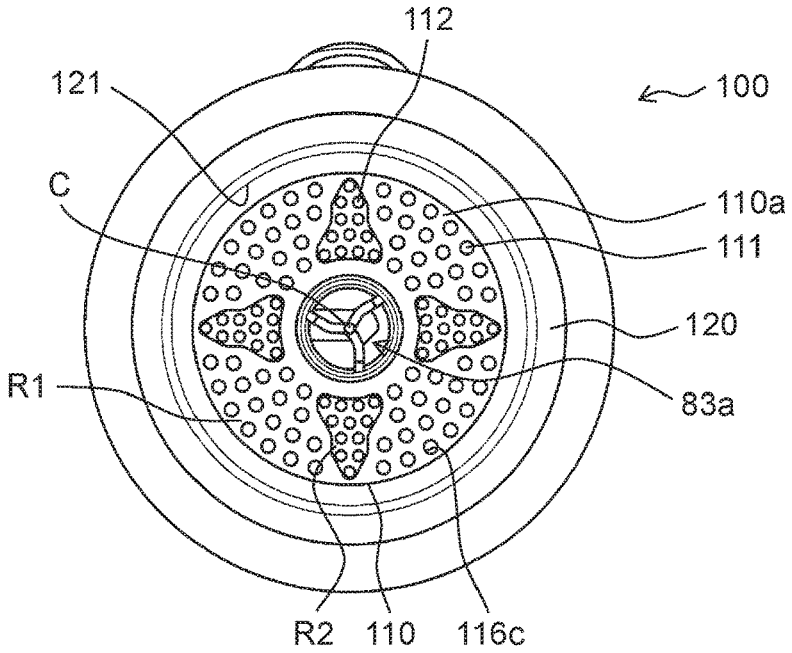
FIG. 8 illustrates a head of the beauty apparatus according to the exemplary embodiment of the present disclosure, as viewed along an axis of rotation.
Figure 9:
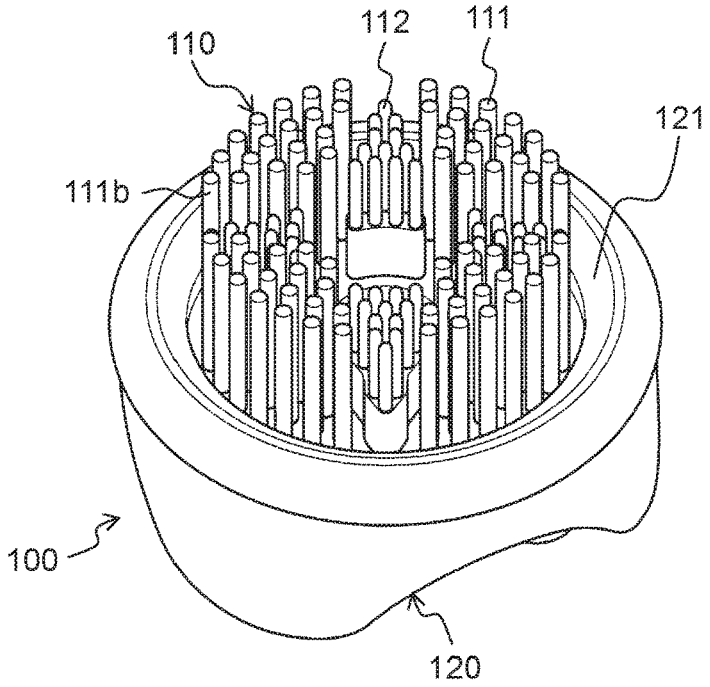
FIG. 9 is a perspective view of the head of the beauty apparatus according to the exemplary embodiment of the present disclosure.
Figure 10:
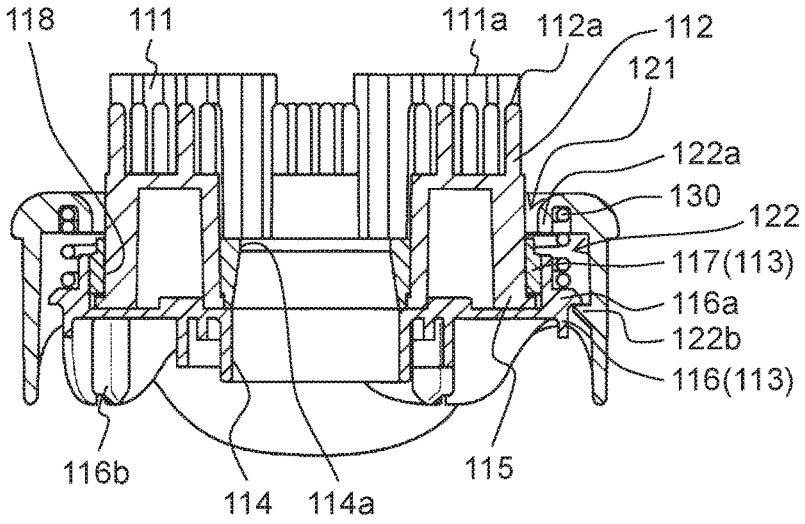
FIG. 10 is a sectional view of the head of the beauty apparatus according to the exemplary embodiment of the present disclosure.

A description is provided next of a structure of head 100. FIGS. 8 to 10 illustrate head 100 having brush part 110 to which the torque is transmitted by ring gear 93, which is the second transmission mechanism.

Head 100 includes brush part 110 and substantially cylindrical head case 120 that is formed with opening 121 for passage of the foam (cleanser) and disposed to surround brush part 110.

In the present exemplary embodiment, brush part 110 is rotatably and movably supported by head case 120.

Specifically, head case 120 is formed with, as shown in FIG. 10, groove 122 in its inner peripheral surface. This groove 122 receives engagement part 116*a* of brush part 110, so that brush part 110 supported by head case 120 is capable of the rotation and the movement (reciprocation along the axis of rotation) with respect to head case 120.

The inner peripheral surface of head case 120 is also formed with a plurality of recesses (not shown) for engagement with the respective plurality of projections 94*a* of head mount 94. Through the engagement of these recesses (not shown) with respective projections 94*a*, head case 120 is mounted to head mount 94. It is to be noted that head mount 94 is fixed to housing 11 in a non-rotatable manner, and head case 120 is mounted to head mount 94 in a non-rotatable manner. Thus, head case 120 is non-rotatably mounted to main body 10 when head 100 is mounted to main body 10.

Within groove 122, first restricting part 122*a* and a plurality of second restricting parts 122*b* are formed. First restricting part 122*a* restricts excessive projection of brush part 110 from head case 120, while the plurality of second restricting parts 122*b* restricts disengagement of brush part 110 from head case 120. The plurality of second restricting parts 122*b* formed is positioned opposite to first restricting part 122*a* in the present exemplary embodiment and can be, for example, equi-spaced on the inner peripheral surface of head case 120.

With first restricting part 122*a* and second restricting parts 122*b* thus formed within groove 122, brush part 110 supported by head case 120 is capable of reciprocation within a predetermined range along the axis of rotation.

Head 100 further includes elastic member 130 disposed between engagement part 116*a* and first restricting part 122*a* for urging brush part 110 in a direction away from opening 121. As an example of this elastic member 130, a coil spring can be used. It is to be noted that elastic member 130 can be omitted.

Brush part 110 is driven (to at least rotate relatively to main body 10) by the driving force of drive source 14 with head 100 mounted to main body 10. This brush part 110 includes first brushes 111 and second brushes 112.

Brush part 110 further includes base 113 that is formed with discharge hole (hole) 114 for passage of the foam (cleanser), and this base 113 is formed with first brushes 111 and second brushes 112 on its surface having release port 114*a*. Discharge hole 114 can be formed, for example, in a center of base 113. With discharge hole 114 formed in the center of base 113, the foam fed from discharge hole 114 to the surface of base 113 is evenly fed to respective portions of the surface of base 113.

In the present exemplary embodiment, base 113 is divided into first brush base mount 116 and second brush base mount 117, and second brush base mount 117 is formed with holes 118 for allowing second brushes 112 to pass through.

First brush base mount 116 is formed with, on its outer periphery, above-mentioned engagement part 116*a* that is engaged in groove 122. First brush base mount 116 is also formed with a plurality of hooks 116*b* for contact with the plurality of hooks 93*a* of ring gear 93.

Moreover, as shown in FIG. 8, first brush base mount 116 is formed with a plurality of recesses 116*c*, and first brushes 111 are implanted in respective recesses 116*c*, thereby being supported by base 113.

On the other hand, second brushes 112 are formed on base mounts 115. Each of base mounts 115 is held between first brush base mount 116 and second brush base mount 117, whereby second brushes 112 are supported by base 113 via base mounts 115.

When head 100 having such a structure is mounted to main body 10, the recesses (not shown) formed in the inner peripheral surface of head case 120 are brought into engagement with respective projections 94*a* of head mount 94, whereby head case 120 is mounted to head mount 94. Accordingly, hooks 116*b* formed on first brush base mount 116 come into contact with hooks 93*a* formed on ring gear 93, whereby ring gear 93 is permitted to transmit the torque to brush part 110.

Here, discharge hole (hole) 114 formed in brush part 110 communicates with space 83*a* of container 83 via the respective spaces within the components including cam gear 91.

Accordingly, when drive source 14 is driven with head 100 mounted to main body 10, brush part 110 rotates relatively to head case 120 (main body 10), while the foam (cleanser) generated by foam generating mechanism 80 is released from discharge hole 114. In the present exemplary embodiment, to enable the passage of the foam (cleanser), brush part 110 is formed with discharge hole (hole) 114. As described above, also inlet 18 communicates with space 83*a*, so that communication is established between inlet 18 and discharge hole 114 when head 100 is mounted to main body 10.

As described above, brush part 100 includes first brushes 111 and second brushes 112 in the present exemplary embodiment, and first brushes 111 each have tuft 111*b* of a plurality of bristles 111*c*, while second brushes 112 are each thicker than each of bristles 111*c*.

It is preferable that first brushes 111 are made of soft material, while second brushes 112 are made of material harder than the material used for first brushes 111.

Figure 14:
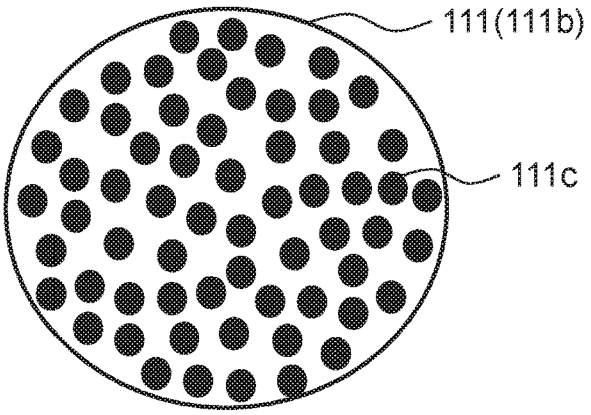
FIG. 14 is a plan view of a first brush according to the exemplary embodiment of the present disclosure.

In the present exemplary embodiment, tuft 111*b* having the plurality of bristles 111*c* is formed and implanted in recess 116*c* formed in first brush base mount 116, thus forming first brush 111 (refer to FIG. 14).

Second brushes 112 are made of silicon, the material harder than the material used for first brushes 111. In the present exemplary embodiment, a comparison of the thickness of first brush 111 is made with the thickness of second brush 112, using each of bristles 111*c* and each of second brushes 112 made of silicon. FIG. 8 illustrates tuft 111*b* that is thicker than second brush 112 and is implanted in recess 116*c*. However, tuft 111*b* can be made thinner than second brush 112.

In the present exemplary embodiment, second brushes 112 disposed around rotation center C of brush part 110 are made greater in number than second brushes 112 disposed along outer circumference 110*a* of brush part 110.

Specifically, second brushes 112 are disposed on a plurality of concentric circles that have a center at rotation center C of brush part 110.

When a comparison is made of numbers of second brushes 112 disposed on two radially adjacent concentric circles among the plurality of concentric circles, the number of second brushes 112 disposed on the concentric circle closer to rotation center C of brush part 110 is made not less than the number of second brushes 112 disposed on the outer concentric circle.

When viewed along a rotation center axis (from a plane of brush part 110), the brushes (first brushes 111 and second brushes 112) are disposed in a region of brush part 110 that is divided into regions R1 where first brushes 111 are disposed and regions R2 where second brushes 112 are disposed.

Specifically, as shown in FIG. 8, the region of brush part 110 where the brushes (first brushes 111 and second brushes 112) are disposed has four regions R1 where first brushes 111 are disposed and four regions R2 where second brushes 112 are disposed.

In addition, regions R1 where first brushes 111 are disposed and regions R2 where second brushes 112 are disposed are present in a circumferentially alternating manner.

The present exemplary embodiment has the plurality of circumferentially formed regions R2 where second brushes 112 are disposed.

In each of four regions R2 where second brushes 112 are disposed, a row of one brush 112, a row of two brushes 112 a row of three brushes 112, and a row of four brushes 112 are formed in this order from outer circumference 110*a* to an inner circumference of brush part 110.

This means that when a comparison is made of numbers of second brushes 112 disposed on the two radially adjacent concentric circles even in each of regions R2, the number of second brushes 112 disposed on the concentric circle closer to rotation center C of brush part 110 is not less than the number of second brushes 112 disposed on the outer concentric circle.

Accordingly, four regions R2 where second brushes 112 are disposed are arranged in a substantially radial pattern. Moreover, in the present exemplary embodiment, these four regions R2 for second brushes 112 are arranged to be substantially symmetrical (with respect to rotation center C and a straight line passing through rotation center C).

Even on the innermost side (the closest concentric circle to rotation center C), regions R1 where first brushes 111 are disposed and regions R2 where second brushes 112 are disposed are present in a circumferentially alternating manner.

Even on the outermost side (the furthest concentric circle from rotation center C), regions R1 where first brushes 111 are disposed and regions R2 where second brushes 112 are disposed are present in a circumferentially alternating manner.

In the present exemplary embodiment, the region of brush part 110 where the brushes (first brushes 111 and second brushes 112) are disposed in brush part 110 has substantially trapezoidal regions R1 and substantially triangular regions R2.

Here, an area of region R2 (a total area of four regions R2 in the present exemplary embodiment) where second brushes 112 are disposed is preferably not more than a half of an area of region R1 (a total area of four regions R1 in the present exemplary embodiment) where first brushes 111 are disposed.

To allow second brushes 112 to exhibit its cleaning power, the area of region R2 is preferably not less than 20 percent of the area of region R1.

Furthermore, in the present exemplary embodiment, leading ends 111*a* of first brushes 111 project further than leading ends 112*a* of second brushes 112.

In other words, when brush part 110 is brought into contact with the skin, first brushes 111 contact the skin earlier than second brushes 112.

It is to be noted that a distance from leading ends 111*a* of first brushes 111 to leading ends 112*a* of second brushes 112 can be, for example, about 3 mm.

Beauty apparatus 1 having such a structure can be used to remove dirt from skin by a method such as follows.

First, head 100 is mounted to main body 10. Next, lid 17 is opened, a predetermined amount of the foaming agent is poured into space 83*a* from inlet 18, and a predetermined amount of the water is poured into space 83*a* from at least one of inlet 18 and discharge hole 114.

With lid 17 being closed, the brushes (first brushes 111 and second brushes 112) of brush part 110 are abutted on a skin surface.

In this state, first operation unit 21 is operated to change drive source 14 from OFF to ON.

Drive source 14 is driven accordingly, and in association with this, the driving force is transmitted to foam generating mechanism 80 and brush part 110. By being driven, foam generating mechanism 80 generates foam (from the cleanser), and the foam is fed through discharge hole 114 to the surface of base 113. This results in such a state that the foam is present between the brushes (first brushes 111 and second brushes 112) of brush part 110 and the skin.

By being driven, brush part 110 rotates relatively to head case 120 (main body 10), when the dirt is removed from the skin by the rotating brushes (first brushes 111 and second brushes 112).

Specifically, with thick second brushes 112 abutted on the skin surface while being rotated, dead skin cells that are hard to remove with normal brushes are removed, while the dirt is removed from the skin surface by the brushes (first brushes 111) having thinner bristles 111*c*.

In cases where thorough removal of makeup or the like that is put on skin is desired, a method such as follows can be used.

First, head 100 is mounted to main body 10. Next, lid 17 is opened, a predetermined amount of the foaming agent is poured into space 83*a* from inlet 18, and a predetermined amount of the water is poured into space 83*a* from at least one of inlet 18 and discharge hole 114.

Thereafter, second operation unit 22 is operated to change warming mechanism 30 from OFF to ON. Warming surface 36 heated by heater 31 is abutted on the skin for warming the skin. Prewarming the skin in this way facilitates the removal of, for example, the makeup put on the skin.

After the skin is warmed by warming mechanism 30 for a certain time, second operation unit 22 is operated to change warming mechanism 30 from ON to OFF.

With the brushes (first brushes 111 and second brushes 112) of brush part 110 abutted on a skin surface, first operation unit 21 is operated to change drive source 14 from OFF to ON, thus driving foam generating mechanism 80 and brush part 110.

The foam generated is fed to the surface of base 113 while the brushes (first brushes 111 and second brushes 112) are rotated, thereby removing dirt from the skin.

To cause brush part 110 to rotate on rotation center C and move along the axis of rotation (vertically in FIG. 4) with head 100 mounted to main body 10, cam gear 91, which is the first transmission mechanism, only have to transmit the torque to brush part 110.

This means that brush part 110 only have to be formed with, in place of hooks 116*b*, hooks that are brought into contact with hooks 91*d* of cam gear 91 when head 100 is mounted to main body 10.

In this way, associated with the rotation of cam gear 91, brush 110 rotates.

As cam gear 91 moves in the first axial direction, brush part 110 is pressed and moves in a direction away from main body 10, that is to say, in the first axial direction.

On the other hand, when cam gear 91 moves in the second axial direction, at least one of gravity acting on brush part 110 and reaction force of elastic member 130 disposed on head 100 causes brush part 110 to move in a direction toward main body 10, that is to say, in the second axial direction.

The torque transmitted to brush part 110 by cam gear 91 with head 100 mounted to main body 10 can cause brush part 110 to rotate and move axially (reciprocate: oscillate) relatively to head case 120 (main body 10). In this case, the dirt is removed from the skin through the rotation and the oscillation of brush part 110.

As described above, beauty apparatus 1 according to the present exemplary embodiment includes main body 10 including grip 10*a*, and brush part 110 rotatably mounted to main body 10.

Brush part 110 includes first brushes 111 each having tuft 111*b* having the plurality of bristles 111*c*, and second brushes 112 each of which is thicker than each of the plurality of bristles 111*c*.

In addition, second brushes 112 disposed around rotation center C of brush part 110 are greater in number than second brushes 112 disposed along outer circumference 110*a* of brush part 110.

Accordingly, difference in skin cleaning power is reduced between a side of rotation center C and a side of outer circumference 110*a* of brush part 110 when brush part 110 is rotated with the brushes (first brushes 111 and second brushes 112) abutted on the skin surface for skin cleaning. Consequently, more uniform removal of the dirt from the skin can be achieved.

By being abutted on the skin surface while being rotated, thick second brushes 112 can remove the dead skin cells that are hard to remove with the normal brushes, while the brushes (first brushes 111) having thinner bristles 111*c* can remove the dirt from the skin surface. Here, the dead skin cells can be removed more efficiently even near rotation center C where peripheral velocity is low, so that the dirt can be removed more uniformly from the skin.

Second brushes 112 are disposed on the concentric circles that have a center at rotation center C of brush part 110.

When the numbers of second brushes 112 disposed on the radially adjacent concentric circles are compared, the number of second brushes 112 disposed on the concentric circle closer to rotation center C of brush part 110 is not less than the number of second brushes 112 disposed on the outer concentric circle.

Accordingly, the difference in skin cleaning power can be reduced further between the side of rotation center C and the side of outer circumference 110*a* of brush part 110, thereby enabling more uniform removal of the dirt from the skin.

Second brushes 112 are higher in hardness than first brushes 111.

This enables more reliable removal of the dead skin cells that are hard to remove with the normal brushes.

Second brushes 112 are made of silicon.

Second brushes 112 made of silicon can thus remove the dead skin cells adhering to the skin surface by rubbing the skin with reduced skin irritation.

Leading ends 111*a* of first brushes 111 project further than leading ends 112*a* of second brushes 112.

In this way, second brushes 112 are prevented from abutting strongly on the skin, thereby reducing skin irritation.

When viewed along the rotation center axis, brush part 110 is divided into regions R1 where first brushes 111 are disposed and regions R2 where second brushes 112 are disposed.

With second brushes 112 disposed in the predetermined regions, skin cleaning power can be increased as compared with cases where second brushes 112 are disposed dispersively.

The plurality of regions R2 where second brushes 112 are disposed is formed circumferentially.

Accordingly, when brush part 110 is rotated with the brushes (first brushes 111 and second brushes 112) abutted on the skin surface for skin cleaning, first brushes 111 and second brushes 112 alternate in cleaning a predetermined part of the skin, whereby the skin cleaning power can be increased further with reduced skin irritation.

The area of region R2 where second brushes 112 are disposed is not more than the half of the area of region R1 where first brushes 111 are disposed.

With the area of region R2 where second brushes 112 are disposed being not more than the half of the area of region R1 where first brushes 111 are disposed, more reliable reduction of the skin irritation can be achieved.

Brush part 110 is formed with discharge hole (hole) 114 that enables the passage of the foam (cleanser).

The foam (cleanser) such as present inside main body 10 can be fed to first brushes 111 and second brushes 112 during skin cleaning, thereby increasing the skin cleaning power more In the present exemplary embodiment, foam generating mechanism 80 and brush part 110 are both driven by drive source 14. For this reason, beauty apparatus 1 can be reduced in size and manufacturing cost as compared with cases where foam generating mechanism 80 and brush part 110 are driven by separate drive sources.

In the present exemplary embodiment, warming mechanism 30 is not driven while drive source 14 is driven. In this way, power saving is enabled because the supply of power to warming mechanism 30 can be disabled when warming mechanism 30 is not in use while foam generating mechanism 80 and brush part 110 are in use for skin cleaning.

In the present exemplary embodiment, drive source 14 is not driven while warming mechanism 30 is driven. In this way, power saving is enabled because the supply of power to drive source 14 can be disabled when foam generating mechanism 80 and brush part 110 are not in use while warming mechanism 30 is used to warm the skin. Moreover, brush part 110 that is not turned toward the skin can be prevented from discharging the foam.

The preferred exemplary embodiment of the present disclosure has been described above; however, the present disclosure is not limited by the above exemplary embodiment and enables various modifications.

For example, controller 16 is not limited to the controls shown in the above exemplary embodiment and can perform various controls.

Drive source 14 can be mounted to head 100.

In the above exemplary embodiment, the driving force of drive source 14 is transmitted to foam generating mechanism 80 via first transmission block 50, and then to second transmission block 90. This means that with head 100 mounted to main body 10, foam generating mechanism 80 and head 100 are both driven by the driving force of drive source 14. However, foam generating mechanism 80 and brush part 110 can be driven independently by the separate drive sources. Here, those drive sources can be mounted inside main body 10, or alternatively, at least one of those drive sources can be mounted to head 100.

Main body 10 can have inlet 18 omitted. In this case, the foaming agent can be poured into space 83*a* from, for example, discharge hole 114. Because main body 10 is not formed with inlet 18, lid 17 can be omitted.

Main body 10 can be formed integrally with head 100. In other words, a structure such that head 100 cannot be detached from head mount 94 can be used. Here, either the first transmission mechanism or the second transmission mechanism can be omitted from the structure.

Housing 11 can be formed with warming surface 36 on its front or back surface.

Foam generating mechanism 80 can be omitted from the beauty apparatus. In this case, without a supply of the foam (cleanser) or with the foam (cleanser) provided to the skin by the user or another means, the beauty apparatus can remove the dirt from the skin.

The main body, the brush part and other details can also have their specifications (such as shape, size and layout) modified.

Beauty apparatus 1 according to the above exemplary embodiment and beauty apparatuses according to the above modifications can each be used as a part of a beauty apparatus set.

Figure 11:
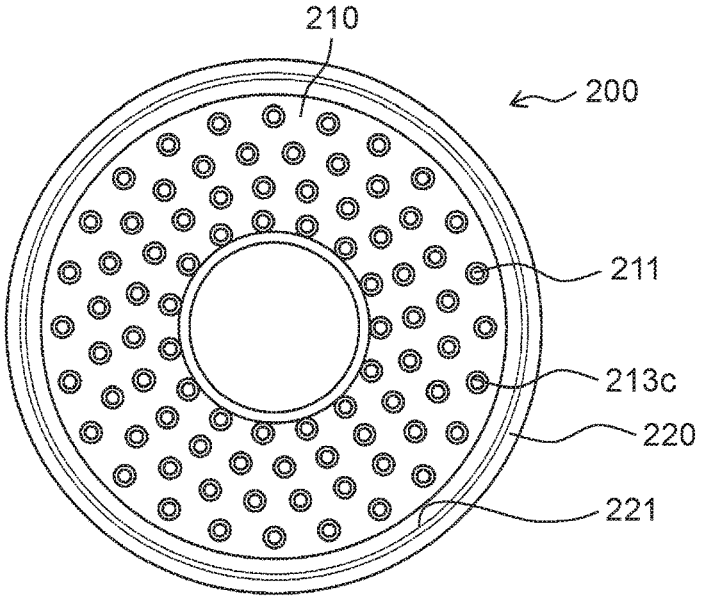
FIG. 11 illustrates another head viewed along an axis of rotation when the beauty apparatus according to the exemplary embodiment of the present disclosure is used as a part of a beauty apparatus set.
Figure 12:
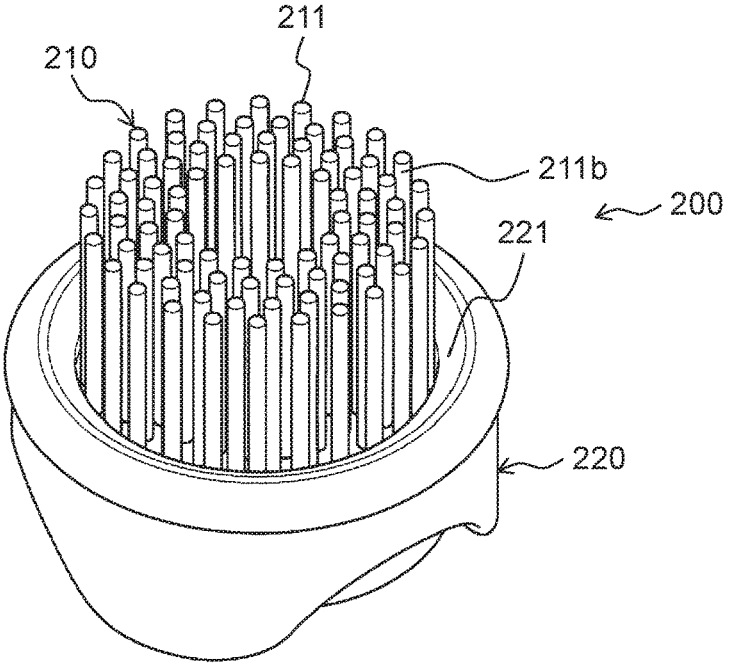
FIG. 12 is a perspective view of the other head when the beauty apparatus according to the exemplary embodiment of the present disclosure is used as the part of the beauty apparatus set.
Figure 13:
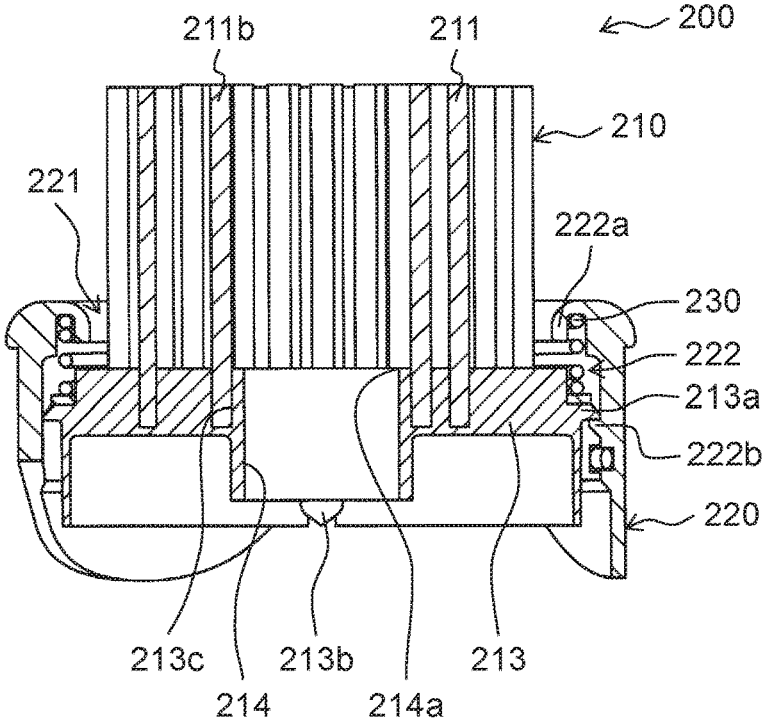
FIG. 13 is a sectional view of the other head when the beauty apparatus according to the exemplary embodiment of the present disclosure is used as the part of the beauty apparatus set.

The beauty apparatus set includes, for example, main body 10, head 100, and second head 200 illustrated by FIGS. 11 to 13, and head 100 or second head 200 can be mounted to main body 10 for use according to purpose.

Second head 200 illustrated by FIGS. 11 to 13 expedites removal of dirt from a target part (such as facial skin) through rubbing of the target part with brushes 211 that are fed with the foam (cleanser).

This second head 200 includes brush part 210 and substantially cylindrical head case 220 that is formed with opening 221 for passage of the foam (cleanser) and disposed to surround brush part 210.

Brush part 210 is rotatably and movably supported by head case 220.

Specifically, head case 220 is formed with, as shown in FIG. 13, groove 222 in its inner peripheral surface. This groove 222 receives engagement part 213*a* of brush part 210, so that brush part 210 supported by head case 220 is capable of the rotation and the movement (reciprocation along an axis of rotation) with respect to head case 220.

The inner peripheral surface of head case 220 is also formed with a plurality of recesses (not shown) for engagement with the respective plurality of projections 94*a* of head mount 94. Through the engagement of these recesses (not shown) with projections 94*a*, head case 220 is mounted to head mount 94. It is to be noted that head mount 94 is fixed to housing 11 in a non-rotatable manner, and head case 220 is mounted to head mount 94 in a non-rotatable manner. Thus, head case 220 is non-rotatably mounted to main body 10 when second head 200 is mounted to main body 10.

Within groove 222, first restricting part 222*a* and a plurality of second restricting parts 222*b* are formed. First restricting part 222*a* restricts excessive projection of brush part 210 from head case 220, while the plurality of second restricting parts 222*b* restricts disengagement of brush part 210 from head case 220. The plurality of second restricting parts 222*b* is positioned opposite to first restricting part 222*a* and can be, for example, equi-spaced on the inner peripheral surface of head case 220.

With first restricting part 222*a* and second restricting parts 222*b* thus formed within groove 222, brush part 210 supported by head case 220 is capable of reciprocation within a predetermined range along the axis of rotation.

Second head 200 further includes elastic member 230 disposed between engagement part 213*a* and first restricting part 222*a* for urging brush part 210 in a direction away from opening 221. As an example of this elastic member 230, a coil spring can be used. It is to be noted that elastic member 230 can be omitted.

Brush part 210 is driven (to at least rotate relatively to main body 10) by the driving force of drive source 14 with second head 200 mounted to main body 10 and has brushes 211 of the same type provided to base 213.

Base 213 is formed with, in its center, discharge hole (hole) 214 for passage of the foam (cleanser), and brushes 211 are formed on a surface of base 213 that has release port 214*a*.

Base 213 is formed with, on its outer periphery, engagement part 213*a* for engagement in groove 222 and is also formed with a plurality of hooks 213*b* for contact with the plurality of hooks 93*a* of ring gear 93.

Moreover, as shown in FIG. 11, base 213 is formed with a plurality of recesses 213*c*, and brushes 211 are implanted in respective recesses 213*c*, thereby being supported by base 213.

It is preferable that brushes 211 are made of soft material. Accordingly, tuft 211*b* of a plurality of bristles is formed and implanted in each recess 213*c* formed in base 213, thus forming brush 211 of second head 200.

When second head 200 having such a structure is mounted to main body 10, the recesses (not shown) formed in the inner peripheral surface of head case 220 are brought into engagement with respective projections 94*a* of head mount 94, whereby head case 220 is mounted to head mount 94. Accordingly, hooks 213*b* formed on base 213 come into contact with hooks 93*a* formed on ring gear 93, whereby ring gear 93 is permitted to transmit the torque to brush part 210.

Here, discharge hole (hole) 214 formed in brush part 210 communicates with space 83*a* of container 83 via the respective spaces within the components including cam gear 91.

Accordingly, when drive source 14 is driven with second head 200 mounted to main body 10, brush part 210 rotates relatively to head case 220 (main body 10), while the foam (cleanser) generated by foam generating mechanism 80 is released from discharge hole 214.

Structurally, when mounted to main body 10, this second head 200 also allows brush part 210 to rotate on rotation center C and move along the axis of rotation (vertically in FIG. 4).

The head included in the beauty apparatus set is not limited to second head 200. Second head 200 can be replaced by another head, or alternatively, another head in addition to second head 200 can be included in the beauty apparatus set.

An example of such another head is a head having a foam stirring mechanism supported on a head case.

As described above, beauty apparatuses according to the present disclosure are capable of more uniform removal of dirt from skin and thus can be applied as beauty apparatuses put to various uses including home use and commercial use.

What is claimed is:

1. A beauty apparatus comprising:

a main body including a grip; and a brush part rotatably mounted to the main body and configured to rotate around a rotation center, wherein the brush part comprises a first brush part including first brushes, each of which includes a plurality of bristles, and a second brush part including second brushes, a thickness of each of the second brushes being thicker than each of the plurality of bristles, wherein a total number of the second brushes of the second brush part disposed around the rotation center of the brush part is greater than a total number of the second brushes of the second brush part disposed along an outer circumference of the brush part, the second brushes of the second brush part are disposed on respective concentric circles having a center of the concentric circles at the rotation center of the brush part, and the second brushes of the second brush part are disposed such that a total number of the second brushes disposed on one concentric circle is greater than a total number of the second brushes disposed on an adjacent concentric circles closer to the outer circumference of the brush part than the one concentric circle.

2. The beauty apparatus according to claim 1, wherein each of the second brushes is higher in hardness than the first brushes.

3. The beauty apparatus according to claim 1, wherein each of the second brushes is made of silicon.

4. The beauty apparatus according to claim 1, wherein a leading end of each of the first brushes projects further than a leading end of each of the second brushes.

5. The beauty apparatus according to claim 1, wherein when viewed along a rotation center axis, the brush part is divided into a region where the first brush part is disposed and a region where the second brush part is disposed.

6. The beauty apparatus according to claim 5, wherein the region where the second brush part is disposed is constituted by a plurality of the regions, and the plurality of regions are formed circumferentially.

7. The beauty apparatus according to claim 5, wherein an area of the region where the second brush part is disposed is not more than a half of an area of the region where the first brush part is disposed.

8. The beauty apparatus according to claim 1, wherein the brush part is formed with a hole enabling passage of a cleanser.

* * * * *